United States Patent [19]

Yoshimura et al.

[11] 4,371,769

[45] Feb. 1, 1983

[54] MICROWAVE HEATING APPARATUS

[75] Inventors: Hirofumi Yoshimura, Nara; Junzo Tanaka, Fujiidera; Nobuo Ikeda, Nara, all of Japan

[73] Assignee: Matsushita Electric Industrial Co., Ltd., Kadoma, Japan

[21] Appl. No.: 62,243

[22] Filed: Jul. 30, 1979

Related U.S. Application Data

[63] Continuation of Ser. No. 47,997, Jun. 13, 1979, abandoned.

[30] Foreign Application Priority Data

Jun. 13, 1978 [JP] Japan ..... 53/71697

[51] Int. Cl.[3] ..... H05B 6/70

[52] U.S. Cl. ..... 219/10.55 F; 219/10.55 B

[58] Field of Search ..... 219/10.55 R, 10.55 D, 219/10.55 F, 10.55 E, 10.55 B

[56] References Cited

U.S. PATENT DOCUMENTS 3,939,320 2/1976 Saad ..... 219/10.55 F

*Primary Examiner*—Arthur T. Grimley

*Attorney, Agent, or Firm*—Wenderoth, Lind & Ponack

[57] ABSTRACT

A microwave heating apparatus has a heating chamber in which an object is to be heated both dielectrically by microwave and by radiant energy. A microwave generator for generating microwaves is disposed above the heating chamber, and a radiant energy heater is located within the heating chamber. A rectangular wave guide extends between the generator and an opening in the chamber for guiding the microwaves generated by the generator into the heating chamber from above, the wave guide being bent generally in the shape of the letter Z and the portion of the wave guide other than the portion adjacent the opening into said heating chamber being spaced from the walls of the heating chamber. Thermal insulation is provided between the chamber and the portion of the wave guide spaced from the walls of the chamber.

5 Claims, 4 Drawing Figures

MICROWAVE HEATING APPARATUS

This application is a continuation of application Ser. No. 47,997 filed June 13, 1979, now abandoned.

This invention relates to a microwave heating apparatus wherein the object to be heated is placed in a heating chamber and is heated by bombardment with microwave energy as well as by increasing the internal temperature of said heating chamber by the use of a heating means located within said heating chamber.

BACKGROUND OF THE INVENTION

In a conventional microwave heating apparatus adapted for both dielectric heating and radiant energy heating, it has been the general practice to install the microwave source beneath a heating chamber to avoid temperature buildups therein, and therefore an elongated wave guide is required to supply the microwave energy to the heating chamber from an overhead position. This arrangement not only has led to large losses of microwave energy but has also resulted in increased structural complexity and manufacturing cost of the apparatus.

When the microwave energy is supplied to the heating chamber from beneath the heating chamber, the wave guide can be short but in such a case, the microwave energy is reflected or partially absorbed by the container holding the object to be heated and by the supporting means, if any, on which the container rests, with the result that the efficiency of dielectric heating is sacrified.

There also are apparatuses in which a microwave generator is positioned above the heating chamber. In such an arrangement, the efficiency of dielectric heating is satisfactory but because the heat from the radiant heating is directly transmitted to the microwave generator, it is necessary to use a high-capacity cooling fan for the microwave generator. This not only means an increased production cost but, because much heat escapes from the heating chamber, the efficiency of radiant heating is sacrificed.

OBJECTS AND BRIEF SUMMARY OF THE INVENTION

It is an object of this invention to provide a microwave heating apparatus wherein a portion of the wave guide by which the microwave output of a microwave generator is propagated to the heating chamber is positioned away from the wall of the heating chamber, whereby the heat of the chamber can not readily reach the microwave generator. With this arrangement, the provision of the microwave generator in an overhead position with respect to the heating chamber does not necessitate the installation of large-capacity cooling fan means and the microwave generator is not thermally influenced in any significant degree. Consequently, it is possible to employ a short wave guide and, hence, reduce the loss of microwave energy at the wave guide wall.

It is another object of this invention to provide a microwave heating apparatus in which a high thermal efficiency of radiant energy heating is ensured without sacrificing the efficiency of dielectric heating.

These objects are achieved by a microwave heating apparatus comprising: a heating chamber in which an object to be heated is dielectrically heated by microwaves and having an opening in the top thereof for admission of microwaves; a microwave generator for generating microwaves which are to be propagated to said heating chamber and disposed above said heating chamber; a radiant energy heater located within said heating chamber for heating the object to be heated; and a rectangular wave guide between said generator and said opening for guiding said microwaves generated by said generator into said heating chamber from above, said wave guide being bent generally in the shape of the letter Z and the portion of said wave guide other than the portion adjacent the opening into said heating chamber being spaced from the walls of said heating chamber. The wave guide is preferably bent generally in the shape of the letter Z in the vertical plane. The distance between the two bends in said wave guide is substantially equal to an odd number multiple of one quarter of the wavelength of the microwaves within said wave guide and said two bends have the same bending angle, which can be an obtuse angle or a right angle.

Thermal insulation is provided on the exterior walls of said chamber, said insulation being in the clearance between the chamber and the portion of said wave guide spaced from the walls of the chamber.

BRIEF DESCRIPTION OF THE DRAWINGS

This invention will be described in detail hereinafter in terms of several preferred embodiments, with reference to the accompanying drawings, in which.

DETAILED DESCRIPTION OF THE INVENTION

Figure 1:
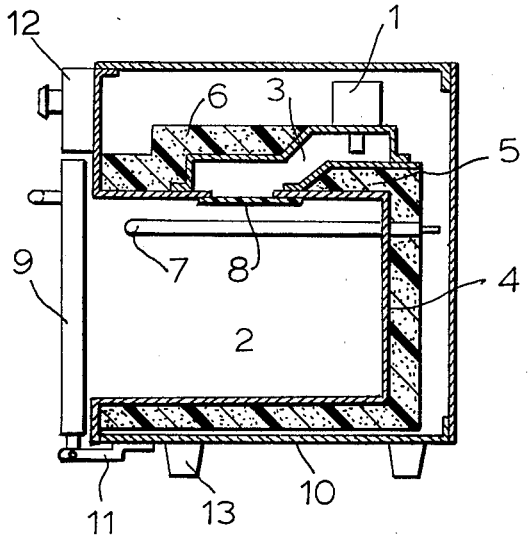
FIG. 1 is a sectional elevation view showing an embodiment of the microwave heating apparatus according to this invention.

FIG. 1 shows an embodiment wherein the principles of this invention are applied to a microwave oven for home use. In this embodiment, a microwave generator such as a magnetron 1 is disposed above and offset from the center of a heating chamber 2, and the microwave radiation generated by the magnetron 1 travels through a rectangular wave guide 3 to the upper central part of the heating chamber 2. The wave guide 3 is bent in such a manner that when seen in a vertical section therethrough it has a configuration approximating the letter "Z" and the portion thereof other than the portion adjacent the opening into the heating chamber is spaced from the wall 4 defining the heating chamber 2 to leave a clearance 5. The exterior surface of the heating chamber wall 4 is surrounded by a thermal insulation 6 so that the heat will not escape from the heating chamber 2. The aforesaid clearance also contains thermal insulation 6.

Disposed in said heating chamber 2 is an electric radiant energy heater 7 for radiant heating of an object to be heated, such as a foodstuff, by increasing the internal temperature of the chamber. In a position where the wave guide 3 opens into the heating chamber, there is provided a sealing plate 8 made of a material having small dielectric losses for blocking the high-temperature air of the heating chamber from entering the wave guide 3. On the front of the heating chamber is a door 9 through which objects to be heated are loaded or unloaded. The door 9 is swingably mounted on the heating chamber by means of hinges 11 secured to a housing 10. There also is provided a control panel 12 on the front of the housing 10, and legs 13 are attached to an exterior bottom wall of the housing 10.

Because of the "Z"-shaped configuration of the wave guide 3, the magnetron 1 can be located externally of the thermal insulation 6, so that the transfer of heat from the heating chamber 2 to the magnetron 1 can take place only via the wave guide 3. Thus, the magnetron is not affected even if microwave heating and radiant energy heating facilities are utilized concurrently.

Figure 2:
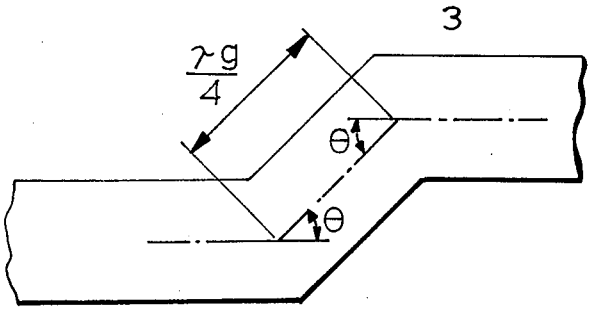
FIG. 2 is a schematic view showing the wave guide on an enlarged scale.

Generally, if a wave guide is bent as in accordance with this invention, an impedance different from the characteristics impedance of the wave guide will be produced at the bend where reflection of the microwave radiation takes place. This result is obviated in the present invention wherein, as illustrated in FIG. 2, adjacent bends in the wave guide 3 have the same bending angle $\theta$ and the distance between the two bends is substantially equal to an odd number multiple of one quarter of the wavelength of the microwaves within the wave guide. Thus, when the angle $\theta$ of one bend is equal to the angle $\theta$ of the other bend, and the distance between the bends is $\lambda g/4$, where $\lambda$ is the wavelength of the microwaves and g is an odd number, the impedances are equal at the two bends and the reflections at the bends which are each shifted by one-half of the wavelength within the wave guide cancel each other, thus resulting in a reduced amount of reflection. Thus, the efficiency of wave propagation is on the same order as that of a straight wave guide. When the wave guide is bent in the vertical plane, the guide becomes especially compact, thus making it easy to install the magnetron 1.

Figure 3:
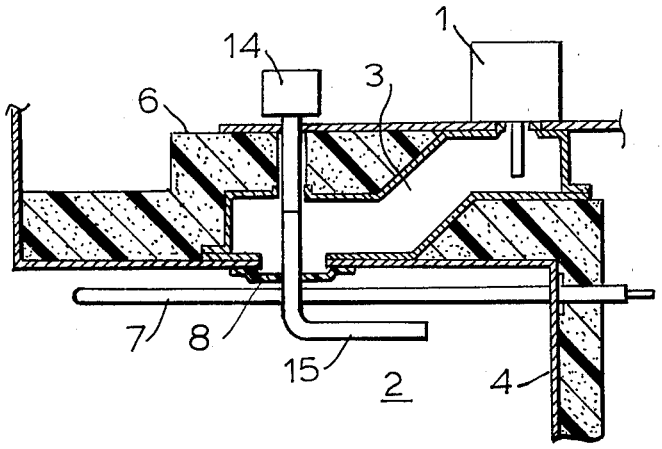
FIG. 3 is a sectional view showing the principal parts of another embodiment of this invention.

In the embodiment of FIG. 3, to improve the distribution of dielectric heating within the heating chamber 2, an antenna driven by a motor 14 is provided in addition to the elements shown in FIG. 1. The bending of the wave guide 3 in the vertical plane facilitates the installation of the field coupling antenna 15.

Figure 4:
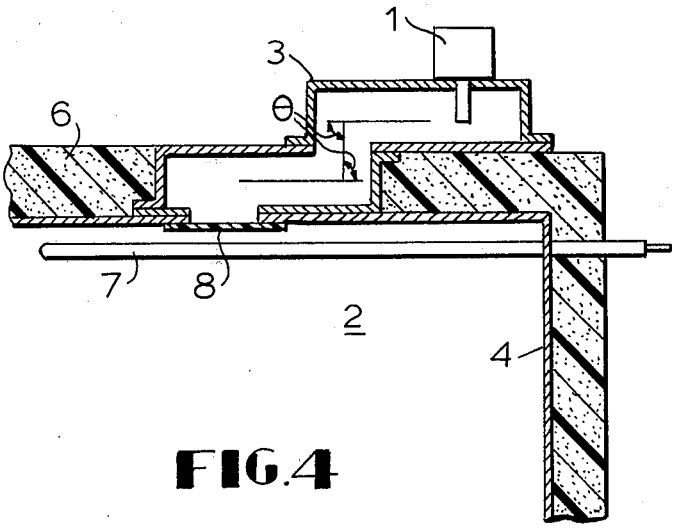
FIG. 4 is a sectional view showing the principal parts of a still another embodiment of this invention.

The embodiment of FIG. 4 differs from that of FIG. 1 in that the bending angle $\theta$ of wave guide 3 is 90 degrees. Because of this, the manufacture of the wave guide 3 is facilitated and it is also easy to obtain a high degree of accuracy. Moreover, the wave reflection is not so great.

As will be apparent from the foregoing description, the microwave heating apparatus according to this invention provides the following advantageous results:

(1) Because the joint between the wave guide and the magnetron is remote from the heating chamber, the heat of the heating chamber is transferred to the magnetron only through the wave guide. Therefore, the heat of the chamber is not readily transmitted to the magnetron. Consequently, both radiant heating and dielectric heating can be accomplished concurrently;

(2) Because of the reduced longitudinal dimension of the wave guide, the loss of microwave energy at the wave guide walls is minimized;

(3) Since the heat in the heating chamber does not readily escape, the temperature buildup within the heating chamber occurs quickly. This means that the capacity of the heater can be small and, hence, the power consumption thereof is reduced;

(4) Because the two bends in the wave guide are identical and the distance between these two bends is equal to an odd number multiple of one-quarter of the wavelength within the wave guide, the respective reflections of microwave radiation cancel each other. Therefore, the microwave propagation efficiency of the wave guide is high and the output of the magnetron is almost completely absorbed by the object to be heated;

(5) Even when the heating chamber is self-cleaned by increasing its internal temperature to about 500° C., the transfer of heat to the magnetron is negligible and well tolerated by the magnetron;

(6) Because the magnetron and other parts are less subject to temperature buildups, their useful lives are increased and any cooling fan motors can be of reduced size;

(7) Since it is unnecessary to employ a long wave guide, the heating apparatus can be designed as a compact unit. This is not only economical but also requires less installation space.

The embodiments of the invention in which an exclusive property or privilege is claimed are defined as follows:

1. A microwave heating apparatus comprising:

a heating chamber in which an object to be heated is dielectrically heated by microwaves and having an opening in the top thereof for admission of microwaves;

a microwave generator for generating microwaves which are to be propagated to said heating chamber and disposed above said heating chamber;

a radiant energy heater located within said heating chamber for heating the object to be heated; and a rectangular wave guide between said generator and said opening for guiding said microwaves generated by said generator into said heating chamber from above, said wave guide being bent generally in the shape of the letter Z and having two bends, said two bends being identical and the distance between said two bends within said wave guide being an odd number multiple of one-quarter of the wave-length of the microwaves within the wave guide and the portion of said wave guide other than the portion adjacent the opening into said heating chamber being spaced from the walls of said heating chamber.

2. A microwave heating apparatus as claimed in claim in which said wave guide is bent generally in the shape of the letter Z in the vertical plane.

3. A microwave heating apparatus as claimed in claim 1 in which said angle is an obtuse angle.

4. A microwave heating apparatus as claimed in claim 1 in which said angle is a right angle.

5. A microwave heating apparatus as claimed in claim 1 further comprising thermal insulation on the exterior walls of said chamber, said insulation being in the clearance between the chamber and the portion of said wave guide spaced from the walls of the chamber.

* * * * *